US008545092B2

(12) United States Patent
Habring et al.

(10) Patent No.: US 8,545,092 B2
(45) Date of Patent: Oct. 1, 2013

(54) TIMEPIECE COMPRISING A CHRONOGRAPH MECHANISM

(75) Inventors: Richard Habring, Volkermarkt (AT); Sebastien Chaulmontet, Zurich (CH)

(73) Assignee: Manufacture la Joux-Perret SA, La Chaux-de-Fonds (CH)

( * ) Notice: Subject to any disclaimer, the term of this patent is extended or adjusted under 35 U.S.C. 154(b) by 611 days.

(21) Appl. No.: 12/866,305

(22) PCT Filed: Feb. 6, 2009

(86) PCT No.: PCT/EP2009/051400
§ 371 (c)(1),
(2), (4) Date: May 8, 2010

(87) PCT Pub. No.: WO2009/098307
PCT Pub. Date: Aug. 13, 2009

(65) Prior Publication Data

US 2010/0322038 A1 Dec. 23, 2010

(30) Foreign Application Priority Data

Feb. 8, 2008 (CH) ..... 0173/08

(51) Int. Cl.
*G04F 7/08* (2006.01)

(52) U.S. Cl.
USPC ..... 368/106; 368/101

(58) Field of Classification Search
USPC ..... 368/101–106
See application file for complete search history.

(56) References Cited

U.S. PATENT DOCUMENTS

| | | | | |
|---|---|---|---|---|
| 3,430,434 | A | 3/1969 | Piguet | |
| 3,890,779 | A | 6/1975 | Capt et al. | |
| 6,669,361 | B1 * | 12/2003 | Lizzi | 368/187 |
| 2005/0007888 | A1 * | 1/2005 | Jolidon | 368/110 |

FOREIGN PATENT DOCUMENTS

| | | |
|---|---|---|
| CH | 3451 | 9/1891 |
| CH | 59206 | 5/1913 |
| CH | 212585 | 11/1940 |
| CH | 216 001 | 7/1941 |
| CH | 460 651 | 2/1968 |
| CH | 548 061 | 4/1974 |
| FR | 1 064 673 | 5/1954 |

OTHER PUBLICATIONS

Reymondin et al, "Theorie de I'horlogerie", Federation des Ecoles Techniques, 1998, ISBN 2-940025-10-X, pp. 225-252.
International Search Report dated Jun. 29, 2009, from corresponding PCT application.
Swiss Search Report dated Sep. 1, 2008, from corresponding Swiss application.

* cited by examiner

*Primary Examiner* — Renee Luebke
*Assistant Examiner* — Jason Collins
(74) *Attorney, Agent, or Firm* — Young & Thompson

(57) ABSTRACT

A timepiece with a movement that includes: a power source; an element for displaying the current time; a chronograph mechanism including a control mobile (60) including at least one control member for activating the start, stop and reset functions of the chronograph. The control mobile (60) further includes a driving member having a toothed sector (84) kinematically connected to the control member. The timepiece further includes a button that can be rotated, the button being rigidly connected by teeth that can be kinematically connected to the toothed sector so that the pivoting of the button activates the start, stop and reset functions of the chronograph.

20 Claims, 7 Drawing Sheets

TIMEPIECE COMPRISING A CHRONOGRAPH MECHANISM

TECHNICAL FIELD

The present invention relates to the field of mechanical horology. It more particularly concerns a timepiece comprising a movement equipped with:

a power source, means for displaying the current time, and a chronograph mechanism comprising a control mobile including at least one control member to activate the start, stop and reset functions of the chronograph.

BACKGROUND OF THE INVENTION

Chronograph mechanisms are varied and are well known by those skilled in the art. There are two main types, depending on whether the control mobile is a column wheel or a cam. One can in particular refer to the work "Théorie de l'horlogerie" by Reymondin et al, Fédération des Ecoles Techniques, 1998, ISBN 2-940025-10-X, pages 225 to 252, to find details on these mechanisms.

Conventionally, the functions of the chronograph mechanism are activated using two push-pieces, acting on the control mobile, at a driving member. In chronographs with column wheels, the driving member is a toothed plate. In a cam chronograph, there are two shuttles that make up the cam. The shuttles form both the control member and the driving member. Indeed, one of the push-pieces acts on one of the shuttles so that its movement activates the start and stop functions, and the other of the push-pieces acts on the other one of the shuttles so that its movement activates the reset function.

Also known are single push-piece chronographs, in which all of the functions are performed, as the name indicates, by a single push-piece. The latter part acts in translation on a column wheel, the control member of which is adapted to control all of the functions. Elegantly, this push-piece is generally housed in a control arbor and protrudes from the crown situated at the end of the arbor. The latter performs, conventionally, the setting and winding functions of the movement, independently of the chronograph. The winding is done in position 0 of the control arbor, i.e. when the latter is in its proximal position relative to the movement, and the setting is done in position 1 of the control arbor, i.e. in a more remote position of the arbor relative to the movement.

It can be noted that in both types of chronograph, bulky levers with sometimes complex forms are inserted between the push-pieces and the driving member of the control member.

The present invention aims to propose a particularly original alternative to activate the functions of a chronograph mechanism and avoiding the aforementioned drawbacks.

BRIEF DESCRIPTION OF THE INVENTION

More precisely, the invention concerns a timepiece as defined in the first paragraph above, characterized in that the control mobile also comprises a driving member including a toothed sector kinematically connected to the control member. The timepiece also comprises a button capable of being driven in rotation, this button being integral with a toothing capable of being kinematically connected to the toothed sector, such that the pivoting of said button activates the start, stop and reset functions of the chronograph.

It can be noted that, advantageously, the proposed construction makes it possible to eliminate the levers between the control arbor and the driving member. In fact, they can be easily adapted to an existing chronograph mechanism.

Other advantageous features are defined in the claims.

BRIEF DESCRIPTION OF THE DRAWINGS

The present invention is described hereinafter, in reference to the appended drawing, in which.

DETAILED DESCRIPTION OF THE INVENTION

Figure 1:
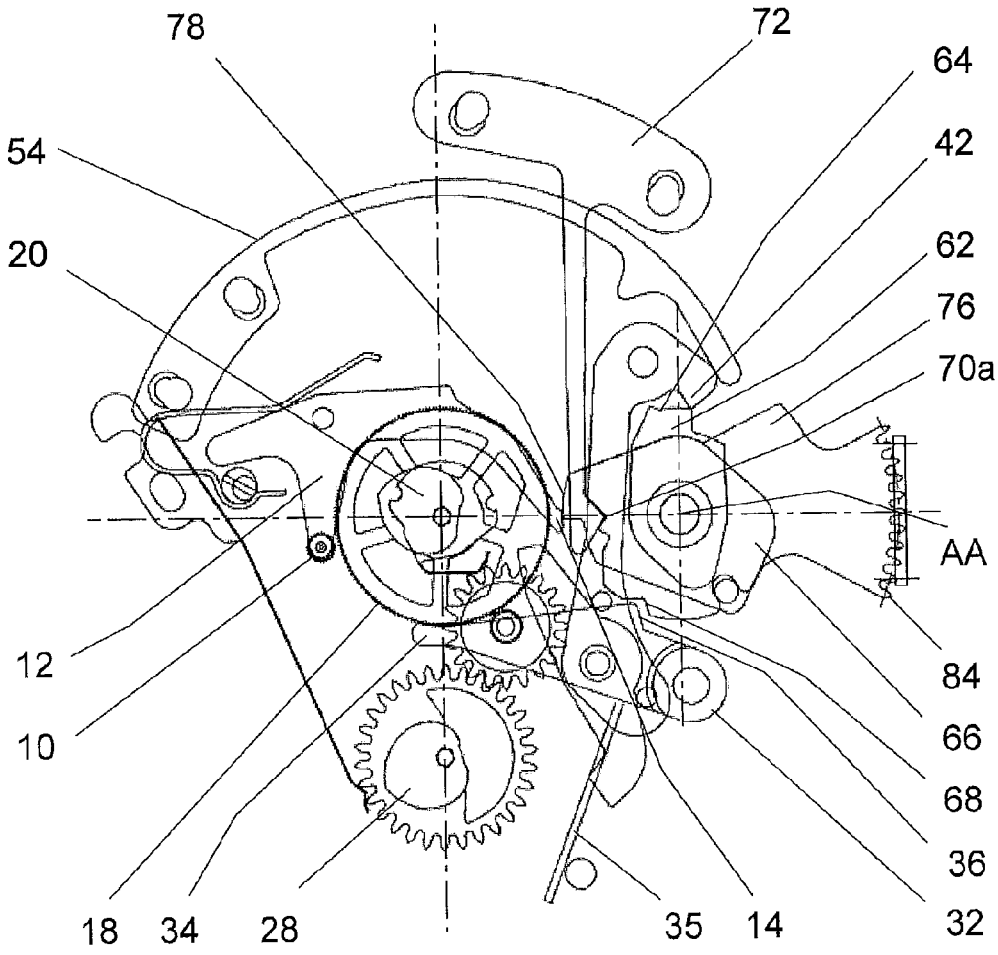
FIG. 1 is a top view of one preferred embodiment of the invention.
Figures 2, 3, 4:
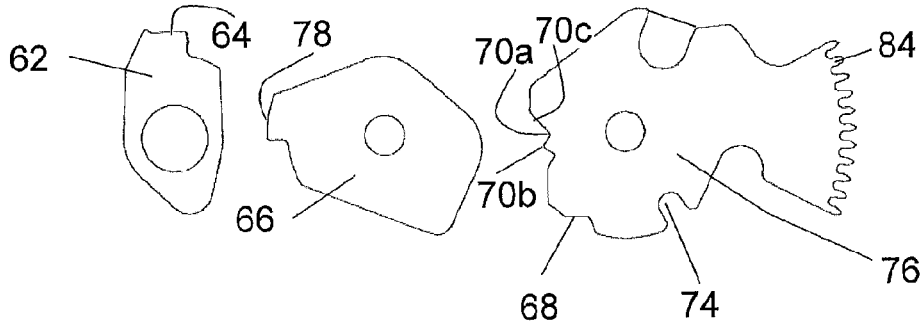
FIGS. 2, 3 and 4 are top views

FIG. 1 shows the main elements of a chronograph mechanism according to one preferred embodiment of the invention, the elements being mounted on a frame. This mechanism can be integrated into or mounted modularly on a basic movement which, for the sake of clarity, is not shown. Naturally, this movement comprises a power source to drive a going train and to display the current time using display members. A control arbor 8, visible in FIG. 2, also called winding stem, is provided conventionally to be able to occupy a first position in which it is arranged to wind the power source, and a second position in which it is arranged to act on the display means. These two functions are well known by those skilled in the art and can be done by a system including a winding pinion, a castle-wheel and a pull-out piece.

Like a conventional cam chronograph mechanism, 10 shows an oscillating pinion, driven continuously by a second wheel of the movement. This pinion 10 is mounted on a lever 12 ending with a first feeler-spindle 14. A spring member 16 exerts a force on the lever 12 tending to bring the pinion 10 into contact with a chronograph wheel 18, designed to turn at a rate of one revolution per minute, when the pinion 10 is coupled.

Typically, the wheel 18 is provided with 60 teeth, so as to provide precise coupling to the second. The chronograph wheel 18 is designed to support a display member for the second of the measured time. A heart-piece 20 is mounted integral on the axis of the wheel 18. Moreover, an elastic finger 22 is also arranged on the wheel 18, to drive once per revolution, an intermediate train 24, engaged with a minute counter wheel 26. The counter wheel 26 is designed to support a display member of the minute of the measured time. A heart-piece 28 is mounted integral on the axis of the wheel 26. A jumper spring 30 ensures the positioning of the wheel 26.

A brake-lever 32 is mounted pivoting on the frame. It includes a brake 34 designed to cooperate with the chronograph wheel 18 to block its rotation, and a second feeler-spindle 36 designed to control the positioning of the brake-lever 32, as will be understood later. A spring 35 is arranged so as to exert a force tending to press the brake 34 against the chronograph wheel 18.

A double-hammer 38 is provided so as to cooperate with the heart-pieces 20 and 28, to reset the second and minute display members. The double-hammer 38 is provided with a lever 40 including a third feeler-spindle 42, designed to control the position of the double-hammer 38. A yoke 44 is pivotably mounted on the lever. On either side of the pivot point, the yoke 44 is provided with first 48 and second 50 support surfaces, respectively, to cooperate with the heart-pieces. Two pins 52 arranged on the lever 40 are provided to limit the pivoting of the yoke 44. A spring 54 exerts a force on the yoke tending to bring the support surfaces 48 and 50 against their respective heart-piece.

A control mobile 60 is arranged to cooperate with the different feeler-spindles and thus to position the above elements so as to activate the start, stop and reset functions of the chronograph mechanism. According to the embodiment chosen as illustration, the control mobile comprises a control member made up of a cam pivoting around an axis AA. One can, for more clarity, refer to FIGS. 2, 3 and 4, which more particularly show the elements of the cam.

The cam includes a first shuttle 62 (FIG. 2), called upper. It has an active zone 64 designed to cooperate with the third feeler-spindle 42 of the double-hammer 38. Depending on the position of the cam, the active zone 64 is arranged so as to oppose or not oppose the force exerted by the spring 54. Respectively, the support surfaces do or do not cooperate with the heart-pieces of the wheels 18 and 26.

The cam includes a second shuttle 66 (FIG. 3), called intermediate, integral in rotation with the first. It has an active zone 78 designed to cooperate with the first feeler-spindle 14 of the yoke 12. Depending on the position of the cam, the active zone 78 is arranged so as to oppose or not oppose the force exerted by the spring member 16. Respectively, the pinion 10 is not coupled or is coupled with the chronograph wheel 18. The shuttle 66 also includes a protruding element, such as a pin 80, the role of which will appear later.

The cam also includes a third shuttle 76 (FIG. 4), called lower. The shuttle 76 has two hollows 70*a*, separated by a tooth 70*b*, with which a jumper 72 cooperates, so as to define the two stable positions of the cam corresponding to the start and stop functions of the chronograph. Moreover, one of the hollows, that defining the stop function, extends beyond the level defined by the tooth 70*b*, by an inclined plane 70*c* with which the jumper 72 cooperates to position the cam for the reset function of the chronograph. Lastly, the shuttle 76 has a housing 74 positioned and dimensioned such that the pin 80 is positioned there, without play in the direction of rotation of the cam. The shuttle 76 also has an active zone 68 designed to cooperate with the second feeler-spindle 36 of the brake-lever 32. Depending on the position of the cam, the active zone 68 is arranged so as to oppose or not oppose the force exerted by the spring 35. Respectively, the brake 34 does not cooperate or cooperates with the chronograph wheel 18.

An additional spring 82 is positioned so as to act on one of the shuttles, preferably on the third shuttle 76, when the reset function is activated, so that it is harder for the user to activate.

According to one important aspect of the invention, the shuttle 76 extends in a toothed sector 84, concentric to the axis AA. One therefore understands that by acting on the toothed sector 84, one will drive the pivoting of the lower cam and, with it, via the cooperation between the pin 80 and the walls of the housing 74, the pivoting of the shuttles 66 and 62. One will note that the pin 80 and the housing 74 could be reversed, the pin 80 being on the shuttle 76 and the housing being on the shuttle 66.

Figure 5:
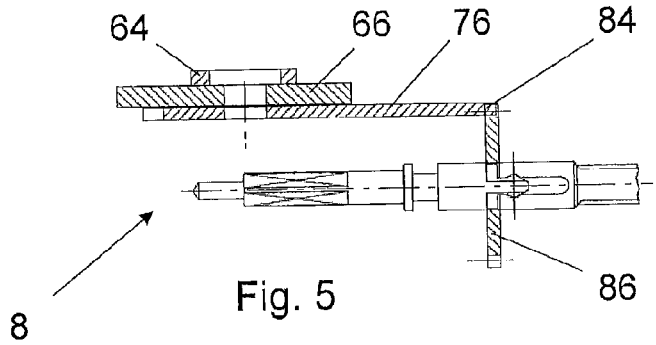
FIG. 5 is a cross-sectional view of details of the mechanism of FIG. 1, FIGS. 6, 7 and 8 illustrate the mechanism in the positions corresponding to the start, stop and reset functions of the chronograph.

To act on the toothed sector, the timepiece according to the invention proposes using the control stem 8 of the movement. Other than the winding pinion and the castle-wheel, the stem 8 supports an additional pinion 86, integral in rotation and designed to mesh with the toothed sector 84, in a predetermined position of the stem 8. As shown in FIG. 5, the pinion 86 and the toothed sector 84 mesh at 90°. One therefore sees that this construction makes it possible to avoid any arm and intermediate lever between the crown of the winding stem, which serves as actuating member for the chronograph, and the control mobile. There is indeed a direct transmission of the power, by meshing between the pinion 86 and the sector 84. The operation is particularly flexible and precise relative to a mechanism comprising arms and levers between the push-pieces and the control mobile.

To allow comfortable operation of the activation of the chronograph functions, the movement of the toothed sector must be fairly quick, relative to the rotation of the crown. Indeed, for example, the starting of the chronograph must be done after a limited rotation of the crown and not after a complete revolution. In this aim, the diameter of the pinion 86 is relatively significant, typically in the vicinity of 5 mm. Moreover, according to the construction illustrated in the drawing, the toothed sector 84 can be situated on the periphery of the movement. The pinion 86 is then relatively close to the crown, which can make it difficult to mount in the case. To offset this problem, the stem is preferably jointed, essentially at the pinion, between the latter part and the crown. The portion of the stem supporting the pinion 86 can thus be easily assembled in the movement, while the other portion, designed to support the crown, can be mounted after interlocking, through the outside.

The position of the castle-wheel and the winding pinion can advantageously be adapted such that, in its proximal position, the stem makes it possible to activate the chronograph functions. There is therefore no need to exert any prior traction on the stem to start the chronograph. When the control stem is pulled into a second position, the power source can be wound and, in a third distal position, the setting can be done.

Figure 6:
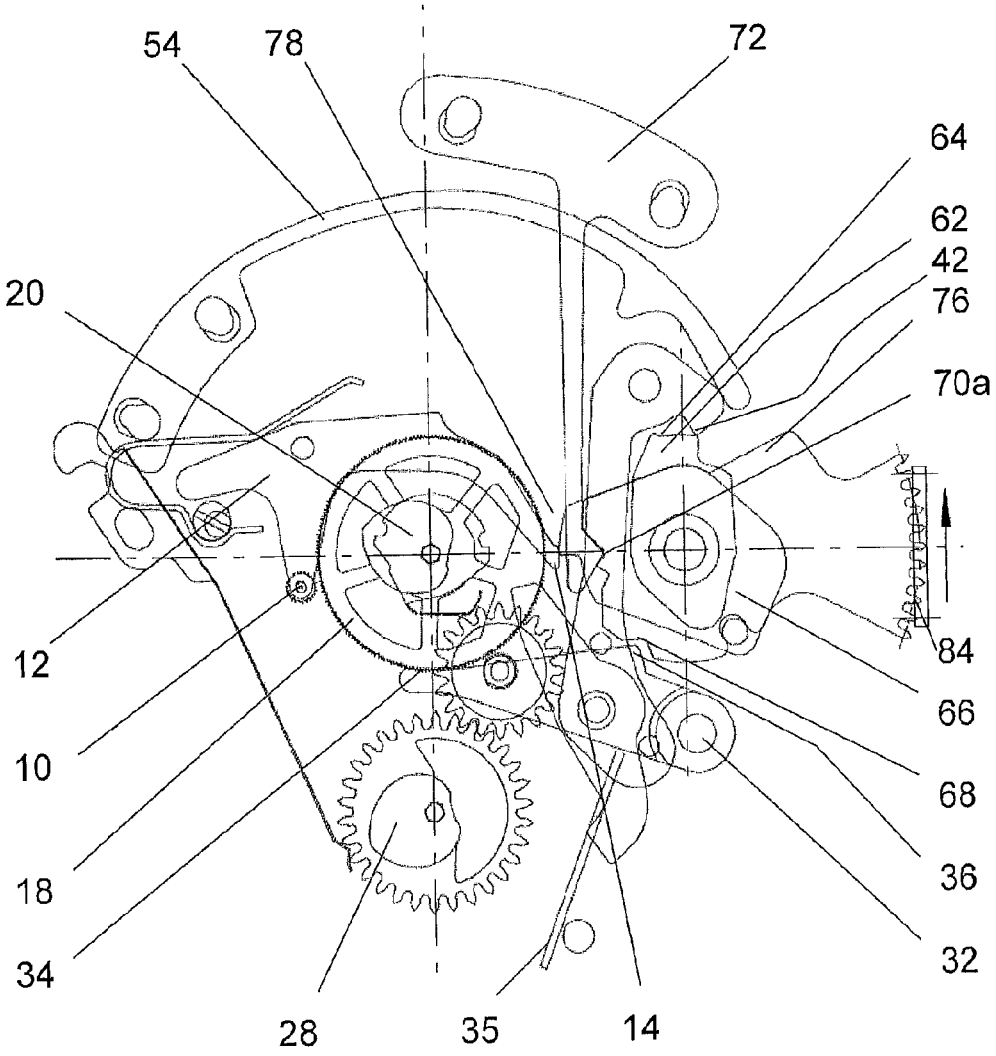
Figure 7:
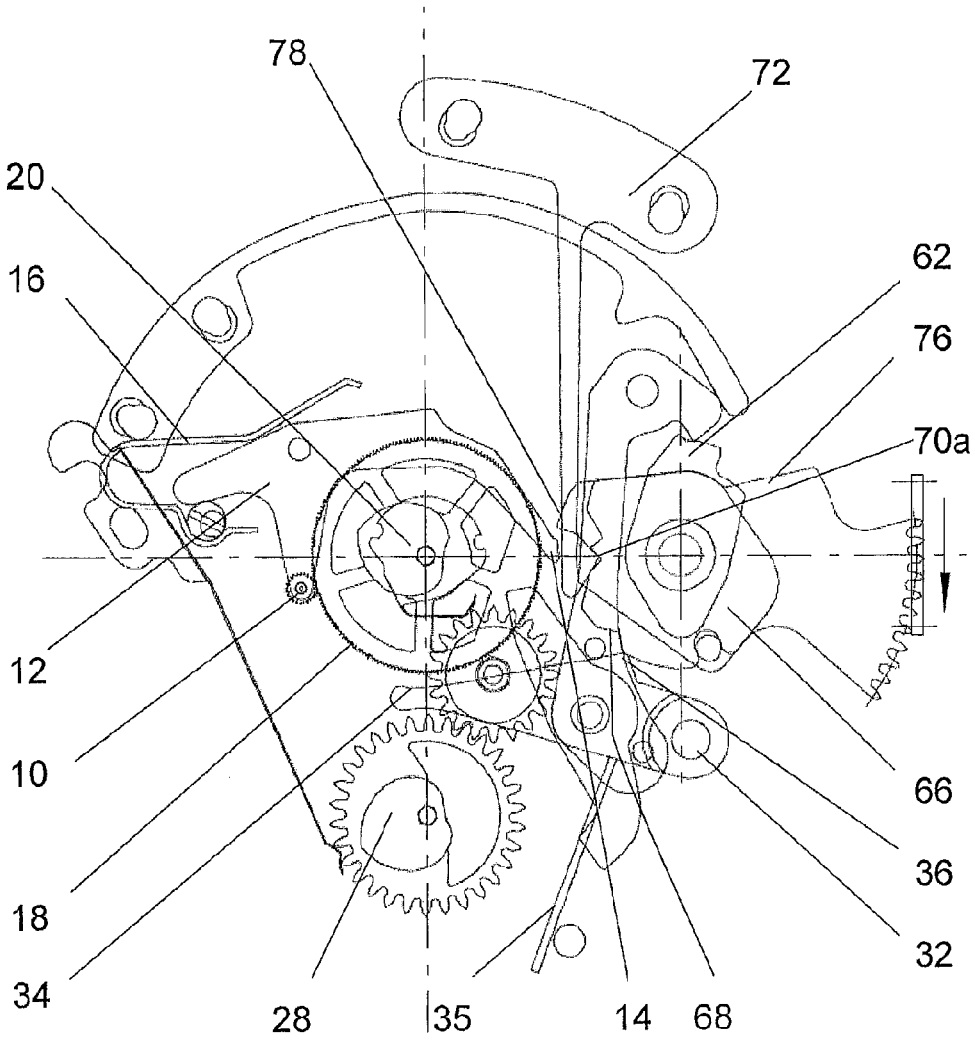
Figure 8:
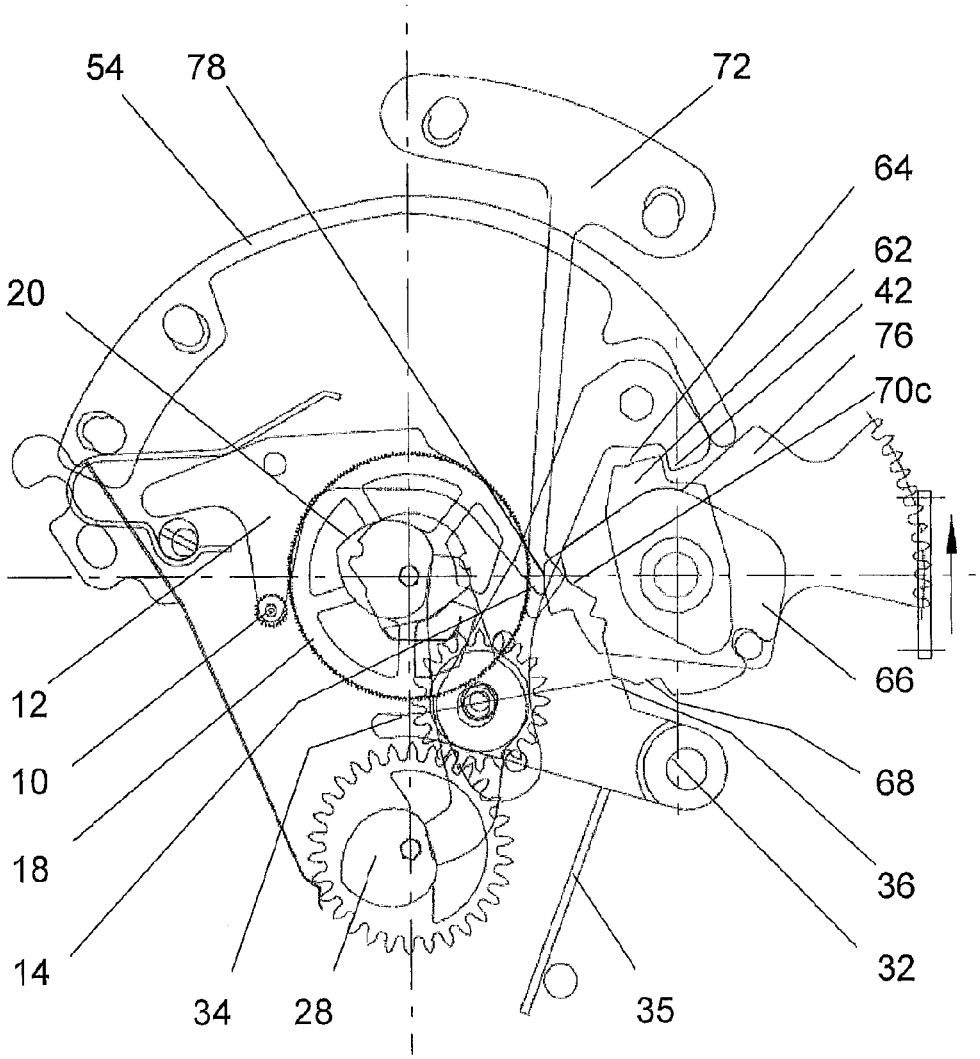

We will now describe the activation of the different functions of the chronograph, in reference to FIGS. 6, 7 and 8.

Idle (FIG. 6), the toothed sector 84 is essentially symmetrical relative to the axis of the control stem. The cam is kept in that position by the jumper 72, which cooperates with a first hollow 70*a*. The first feeler-spindle 14 of the lever 12 bears on the active zone 78 of the shuttle 66. The pinion 10 is uncoupled from the chronograph wheel 18. At the second feeler-spindle 36 of the brake-lever 32, the active zone 68 of the third shuttle 76 does not oppose the spring 35 and the brake 34 cooperates with the wheel 18 to block it. The third feeler-spindle 42 of the double-hammer cooperates with the active zone 64 of the first shuttle 62 to oppose the spring 54. The hammer is raised and the support surfaces do not cooperate with the heart-pieces 20 and 28.

To activate the start function of the chronograph, the crown is pivoted by the wearer in the counterclockwise direction, so as to drive the rotation of the shuttle 76 in the clockwise direction, in reference to FIG. 7. The rotation of the shuttle 76 drives the simultaneous pivoting of the shuttles 66 and 62. The jumper 72 goes into the other hollow 70*a* and thus keeps the cam in that position. The first feeler-spindle 14 of the lever 12 no longer bears on the active zone 78 of the shuttle 66, which therefore no longer opposes the spring 16. The pinion 10 is coupled on the chronograph wheel 18. The second feeler-spindle 36 of the brake-lever 32 bears on the active zone 68 of the third shuttle 76, which opposes the spring 35. The brake 34 no longer cooperates with the wheel 18. The hammer is still raised and the support surfaces do not cooperate with the heart-pieces 20 and 28.

Clockwise pivoting of the crown by the wearer causes the counterclockwise rotation of the shuttle 76, in reference to FIG. 6. The shuttles 66 and 62 also pivot and the jumper 72 goes back into the first hollow 70*a*. One is then in the idle position previously described, the chronograph is stopped. The wearer can restart and stop the chronograph as desired, without resetting.

To activate the reset, the wearer must, in reference to the idle position, by way of which he must necessarily pass, pivot the crown clockwise, driving the counterclockwise rotation of the shuttle 76, in reference to FIG. 8. The shuttles 66 and 62 also pivot, stressing the additional spring 82, and the jumper 72 goes up on the inclined flank 70*c*. The first feeler-spindle 14 of the lever 12 is still bearing on the active zone 78 of the shuttle 66. The pinion 10 is uncoupled from the chronograph wheel 18. The second feeler-spindle 36 of the brake-lever 32 bears on the active zone 68 of the third shuttle 76, which opposes the spring 35. The brake 34 does not cooperate with the wheel 18. The third feeler-spindle 42 of the double-hammer no longer cooperates with the active zone 64 of the first shuttle 62. Under the effect of the spring 54, the hammer falls and the support surfaces press the heart-pieces 20 and 28, to reset the display members. When the user releases the crown, the jumper 72 returns the mechanism to its idle position, through action on the inclined flank 70*c*.

It is therefore the jumper that positions the cam such that the functions can be performed correctly. However, the user could pivot the crown too much, which could cause the shuttles to force on the feeler-spindles. To avoid this, it is possible to have banking elements on the frame, on either side of the shuttle 76.

Thus is proposed a chronograph mechanism making it possible to activate the different functions particularly originally, while eliminating any lever between the control stem and the driving member of the control member.

Figure 9:
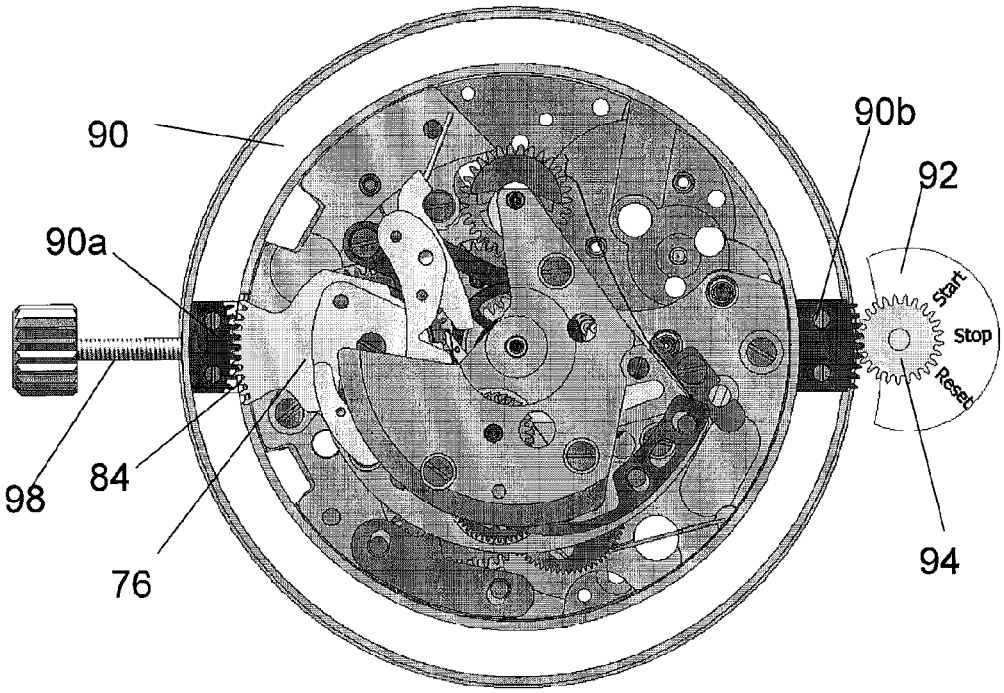
FIGS. 9 and 10 show two other embodiments according to the invention.
Figure 10:
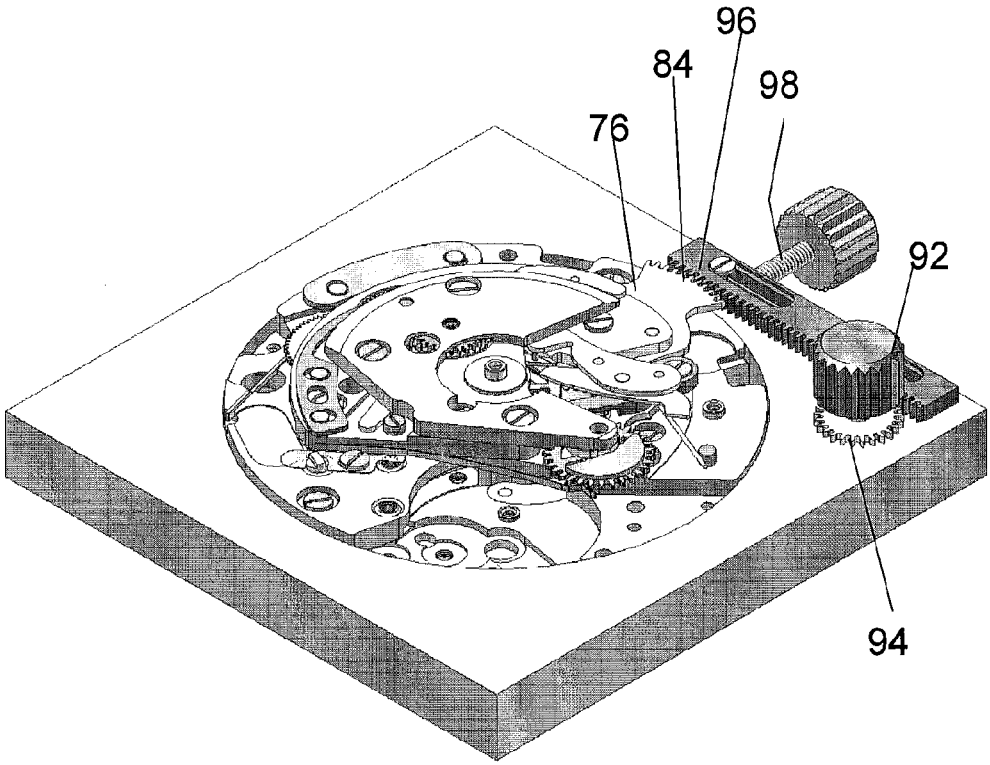

FIGS. 9 and 10 propose two other embodiments, also making it possible to actuate the different functions of the chronograph according to a principle similar to that proposed above.

In FIG. 9, we see the toothed sector 84 ending the third shuttle 76. A ring 90 dimensioned so as to essentially surround the movement is arranged on the casing-ring. More particularly, the inner diameter of the ring 90 is sufficient for the movement to be able to be positioned there, while its outer diameter allows that ring 90 to be masked by the casing ring or inside the watch case. The ring 90 is placed on the casing ring and is guided in rotation, possibly by stones. The ring 90 is at least partially toothed and comprises a first 90*a* and second 90*b* toothing, on its inner periphery and on its outer periphery, respectively. The toothings can be directly notched in the ring, on the entire periphery or not, or, as in the example shown in FIG. 9, be made by attached pieces, making it possible to arrange the toothings only in the required zones. Such an arrangement can be interesting in terms of bulk.

To actuate the chronograph functions, a button 92 is mounted in rotation in the case, so as to be accessible from the outside by the wearer of the watch. In the illustrated example, but non-limitingly, the button 92 can pivot along an axis perpendicular to the plane of the movement. In other words, the button defines a plane essentially parallel to that of the movement. The button 92 is integral in rotation with a toothing, typically assuming the form of a pinion 94 arranged coaxially thereto. This pinion 94 meshes with the ring 90, preferably by the second toothing 90*b* situated at its outer periphery. The toothed sector 84 is engaged with the first toothing 90*a* situated at the inner periphery of the ring.

Thus, by pivoting the button 92, the user can actuate the different functions of the chronograph. One will note that the button 92 can also be mounted pivoting along an axis parallel to that of the movement, the pinion 94 meshing perpendicularly with the ring.

In FIG. 10, there is also a toothed sector 84 ending the third shuttle 76. A rack 96 is mounted mobile in translation inside the case or the movement, being guided by at least one oblong opening, inside which a fixed element cooperates, such as a screw, for example, fixed on a support of the movement or on the case of the movement. A person skilled in the art can use any other means at his disposal to mount the rack. A button 92 is mounted in rotation in the case, in order to be accessible from the outside. In one advantageous embodiment, the button is mounted on the upper portion of the case, on the dial side, possibly in a corner of said case, in the event of a square case with a round dial. As in the preceding embodiment, the button 92 can pivot along an axis perpendicular to the plane of the movement and is integral with a pinion 94, which is coaxial thereto. The rack 96 meshes on one hand with the pinion 94 and on the other hand with the toothed sector 84. A person skilled in the art will easily be able to adapt the different levels of these elements such that the rack 96 can transmit a rotation of the button 92 to the driving member of the chronograph mechanism. In particular, the toothed sector 84 normally being situated on the side of the back of the movement, if the button 92 is situated on the dial side, the pinion 94 can be connected to the button 92 by an arbor that passes through the movement. Thus, by pivoting the button, the user can actuate the different functions of the chronograph.

The embodiments of FIGS. 9 and 10 have the same advantages as above, with the additional advantage of releasing the control stem for a third function, in particular for correcting a date or a GMT, for example. In these embodiments, the control stem 98 no longer has a functional connection with the chronograph mechanism. Moreover, the builder can arrange the control member of the chronograph particularly flexibly, in reference to the button.

The description above was provided as a non-limiting example of the invention. Thus, the control member could also be a column wheel, the toothed sector of the driving member then assuming the form of a wheel. The activation of the different functions will then have to be adapted. Thus, the crown would still have to turn in the same direction to go from one function to the other, the chronograph only being able to function according to the start/stop/reset sequence. Certain details of the embodiments could obviously be adapted by one skilled in the art, in particular at the connection between the shuttles, or in the limitation of the travel of the cam.

The invention claimed is:

1. A timepiece comprising a movement provided with
a power source,
means for displaying the current time,
a chronograph mechanism comprising a control mobile including at least one control member to activate start, stop and reset functions of the chronograph,
wherein the control mobile also comprises a driving member including a toothed sector kinematically connected to the control member,
said timepiece comprising a button capable of being driven in rotation, said button being integral with a toothing capable of being kinematically connected to said toothed sector, such that the pivoting of said button activates the start, stop and reset functions of the chronograph.

2. The timepiece of claim 1, wherein the control member includes a first, a second and a third shuttle, coaxial and integral in rotation, said third shuttle also being the driving member.

3. The timepiece of claim 2, comprising a control stem capable of occupying at least a first and a second position in which it is arranged to wind the power source and the act on the display means, respectively, wherein said button is mounted integral in rotation with the control stem, in that said toothing is a pinion supported by said control stem and wherein said control stem is capable of occupying a third position, in which the pinion cooperates with said toothed sector such that the pivoting of said button activates the start, stop and reset functions of the chronograph.

4. The timepiece of claim 3, wherein the control stem is jointed and defines:

a first portion designed to be situated at least partially outside the movement and to support a crown, and a second portion designed to be situated in the movement and supporting, at its end situated on the crown side, said pinion.

5. The timepiece of claim 3, wherein said third position of the control stem is its proximal position in reference to the movement, in that said first position of the stem is its intermediate position, and wherein said second position of the stem is its distal position in reference to the movement.

6. The timepiece according to claim 2, wherein said third shuttle is kinematically connected to said second shuttle via a protruding element cooperating with a first housing, one of the second shuttle and the third shuttle includes the protruding element and the other of the second shuttle and the third shuttle includes the first housing.

7. The timepiece according to claim 2, wherein the third shuttle has, on its perimeter, a first and a second hollow separated by a tooth, a jumper being designed to cooperate with the first and the second hollows so as to stabilize the control mobile in a first position corresponding to the stop function of the chronograph, and in a second position corresponding to the start function of the chronograph, respectively, and wherein the first hollow is extended by an inclined flank.

8. The timepiece according to claim 2, wherein banking elements are arranged such that said third shuttle evolves between first and second positions.

9. The timepiece of claim 1, comprising a control stem capable of occupying at least a first and a second position in which it is arranged to wind the power source and the act on the display means, respectively, wherein said button is mounted integral in rotation with the control stem, in that said toothing is a pinion supported by said control stem and wherein said control stem is capable of occupying a third position, in which the pinion cooperates with said toothed sector such that the pivoting of said button activates the start, stop and reset functions of the chronograph.

10. The timepiece of claim 9, wherein the control stem is jointed and defines:

a first portion designed to be situated at least partially outside the movement and to support a crown, and a second portion designed to be situated in the movement and supporting, at its end situated on the crown side, said pinion.

11. The timepiece of claim 9, wherein said third position of the control stem is its proximal position in reference to the movement, in that said first position of the stem is its intermediate position, and wherein said second position of the stem is its distal position in reference to the movement.

12. The timepiece according to claim 1, wherein said button is connected to the toothed sector via a toothed ring, essentially surrounding the movement, and mounted mobile in translation.

13. The timepiece of claim 12, wherein said toothing meshes with the outer periphery of the toothed ring, and in that the toothed sector meshes with the inner periphery of the toothed ring.

14. The timepiece according to claim 12, wherein said button is capable of pivoting along an axis perpendicular to the plane of the movement.

15. The timepiece according to claim 12, wherein said third shuttle is kinematically connected to said second shuttle via a protruding element cooperating with a first housing, one of the second shuttle and the third shuttle includes the protruding element and the other of the second shuttle and the third shuttle includes the first housing.

16. The timepiece according to claim 12, wherein the third shuttle has, on its perimeter, a first and a second hollow separated by a tooth, a jumper being designed to cooperate with the first and the second hollows so as to stabilize the control mobile in a first position corresponding to the stop function of the chronograph, and in a second position corresponding to the start function of the chronograph, respectively, and wherein the first hollow is extended by an inclined flank.

17. The timepiece according to claim 12, wherein banking elements are arranged such that said third shuttle evolves between first and second positions.

18. The timepiece according to claim 1, wherein said button is connected to the toothed sector via a rack mounted mobile in translation and meshing, on one hand, with said toothing, and on the other hand, with the toothed sector.

19. The timepiece according to claim 18, wherein said button is capable of pivoting along an axis perpendicular to the plane of the movement.

20. The timepiece of claim 1, wherein the control mobile is a column wheel.

* * * * *